US012251056B2

(12) United States Patent
Lewis et al.

(10) Patent No.: US 12,251,056 B2
(45) Date of Patent: Mar. 18, 2025

(54) DISPENSER WITH ROLL TRANSFER MECHANISM

(71) Applicant: Kimberly-Clark Worldwide, Inc., Neenah, WI (US)

(72) Inventors: Richard P. Lewis, Marietta, GA (US); Klemen Erzen, Preddvor (SL)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/550,699

(22) PCT Filed: Apr. 27, 2021

(86) PCT No.: PCT/US2021/029334
§ 371 (c)(1),
(2) Date: Sep. 15, 2023

(87) PCT Pub. No.: WO2022/231573
PCT Pub. Date: Nov. 3, 2022

(65) Prior Publication Data

US 2024/0292982 A1 Sep. 5, 2024

(51) Int. Cl.
*A47K 10/36* (2006.01)

(52) U.S. Cl.
CPC ..... *A47K 10/36* (2013.01); *A47K 2010/3681* (2013.01); *A47K 10/3687* (2013.01)

(58) Field of Classification Search
CPC ..... A47K 2010/3681
See application file for complete search history.

(56) References Cited

U.S. PATENT DOCUMENTS 4,403,748 A * 9/1983 Cornell ..... A47K 10/3687 226/129
5,400,982 A * 3/1995 Collins ..... A47K 10/36 242/564.4
5,772,291 A * 6/1998 Byrd ..... A47K 10/3656 242/563.2

(Continued)

OTHER PUBLICATIONS

International Search Report and Written Opinion for PCT/US2021/029334 dated Aug. 11, 2021, 8 pages.

*Primary Examiner* — William A. Rivera
(74) *Attorney, Agent, or Firm* — Dority & Manning, P.A.

(57) ABSTRACT

A dispenser for dispensing sheet material from one or more rolls of sheet material is provided. The dispenser includes a housing having an interior volume and a module disposed within the housing including a dispensing mechanism. The dispenser includes a transfer assembly having a rear transfer roller and a front transfer roller disposed on a transfer arm. The transfer arm is disposed in one or more walls of the module via a slot. The transfer arm is configured to be placed in an operating position or a loading position. When in the loading position, the transfer arm extends into a second portion of the slot to provide greater clearance between the front transfer roller and the drive roller to facilitate loading of the sheet material. A transfer assembly is also disclosed having a rear transfer roller disposed in a slot disposed in a second portion of the transfer arm. When in loading position, the rear transfer roller extends into the second portion of the slot to provide greater clearance between the front transfer roller and the drive roller to facilitate loading of the sheet material.

18 Claims, 12 Drawing Sheets

(56) References Cited

U.S. PATENT DOCUMENTS

| | | | | |
|---|---|---|---|---|
| 6,446,901 | B1 * | 9/2002 | Haen | B65H 35/006 242/564.1 |
| 6,460,798 | B1 * | 10/2002 | Haen | A47K 10/3687 242/564.4 |
| 8,418,950 | B2 * | 4/2013 | Hagleitner | A47K 10/3687 242/560.3 |
| 8,448,890 | B2 * | 5/2013 | Hagleitner | A47K 10/3612 242/564.4 |
| 11,478,111 | B2 * | 10/2022 | Osborne, Jr. | A47K 10/3687 |
| 2017/0188760 | A1 * | 7/2017 | Henson | A47K 10/38 |
| 2020/0390295 | A1 | 12/2020 | Osborne | |

* cited by examiner

DISPENSER WITH ROLL TRANSFER MECHANISM

RELATED APPLICATIONS

The present application is the national stage entry of International Patent Application No. PCT/US2021/029334 having a filing date of Apr. 27, 2021, which is incorporated herein in their entirety by reference thereto.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user. Those skilled in the art have spent considerable time designing smart dispensers that can more easily dispense the products noted above. For instance, dual or multiple roll dispensers have been developed and typically incorporate some type of transfer mechanism or device to ensure sequential dispensing of sheet material from an additional roll upon the first roll being depleted by a predetermined amount. The reliability, effectiveness, complexity, and usability of these transfer mechanisms is an important consideration, and the industry is continuously concerned with improving such devices and the overall operation of multiple or dual roll dispensers. The control systems and mechanical aspects of dual or multiple roll dispensers are wide and varied.

In view of the above, improved transfer mechanisms for dual roll and/or multi-roll dispensers are needed.

SUMMARY

In general, the present disclosure is directed to a dispenser for dispensing sheet material from one or more rolls of sheet material. The dispenser includes a housing having an interior volume so as to retain a first roll of sheet material. A module including a dispensing mechanism is disposed within the housing to dispense sheet material. The dispensing mechanism includes a drive roller. The dispenser also includes a transfer assembly having a rear transfer roller and a front transfer roller disposed on a transfer arm. The transfer arm is disposed in one or more walls of the module via a slot. The transfer arm is configured to be placed in an operating position or a loading position. When in the loading position, the transfer arm extends into a second portion of the slot to provide greater clearance between the front transfer roller and the drive roller to facilitate loading of the sheet material.

The other exemplary embodiments, the present disclosure is directed to a dispenser for dispensing sheet material from one or more rolls of sheet material. The dispenser includes a housing having an interior volume so as to retain a first roll of sheet material. A module housing including a dispensing mechanism is disposed within the housing to dispense sheet material. The dispensing mechanism includes a drive roller. The dispenser also includes a transfer assembly having a rear transfer roller and a front transfer roller disposed on a transfer arm. The transfer arm has a first portion and a second portion, the second portion includes a slot having the rear transfer roller disposed therein. The transfer arm is configured to be placed in an operating position or a loading position. When in the loading position, the rear transfer roller extends into a second portion of the slot to provide greater clearance between the front transfer roller and the drive roller to facilitate loading of the sheet material.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
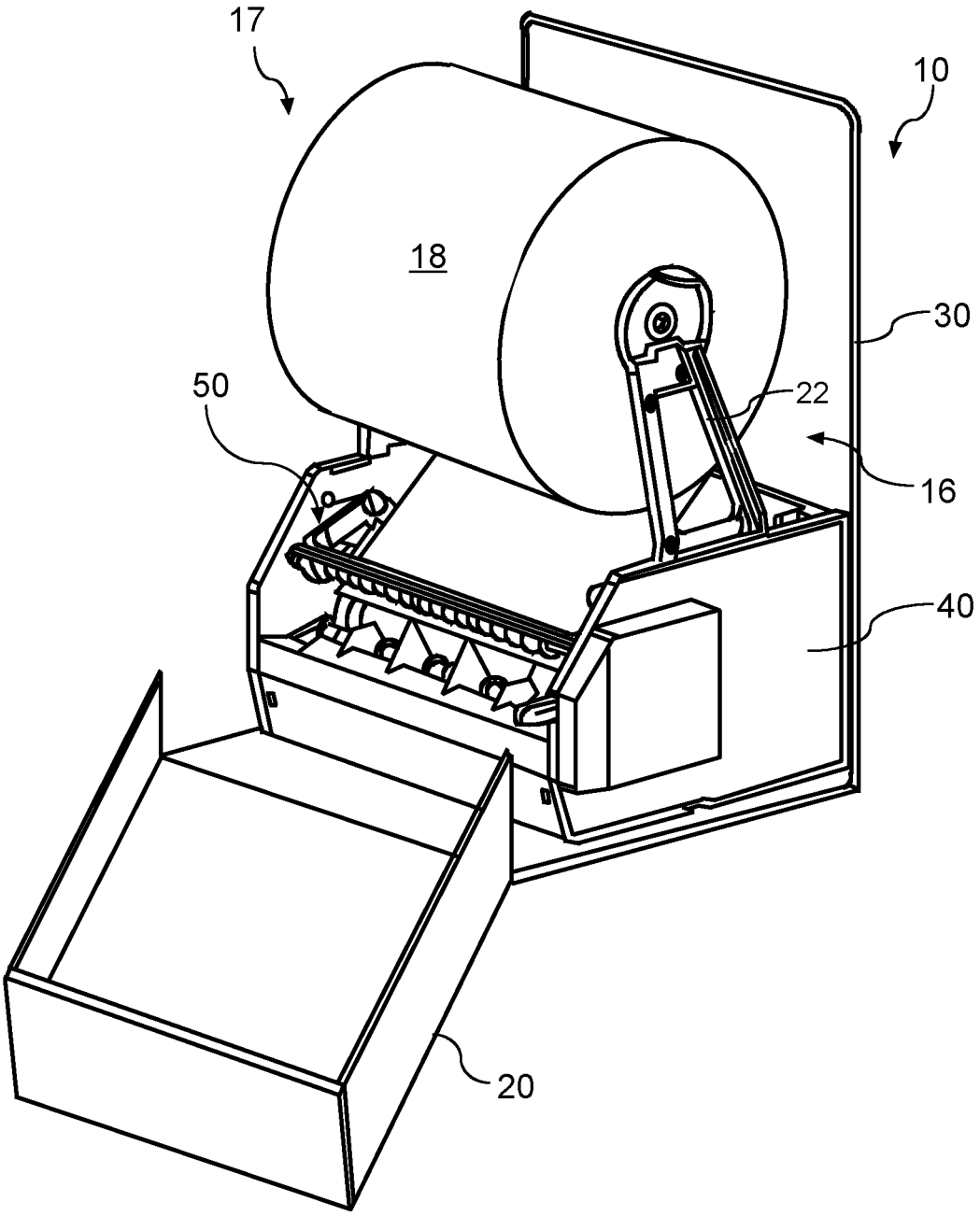
FIG. 1 illustrates a perspective view of a dispenser according to example embodiments of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

As used herein, the terms "first", "second", and "third" may be used interchangeably to distinguish one component from another and are not intended to signify location or importance of the individual components.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

The embodiments including dispensers of the present disclosure, including components thereof, can comprise, consist of, or consist essentially of the essential elements and limitations of the embodiments described herein, as well as any additional or optional components or limitations described herein or otherwise useful.

As used herein, the terms "sheet material" and "paper" means a material that is thin in comparison to its length and breadth. Generally speaking, sheet materials should exhibit a relatively flat planar configuration and be flexible to permit folding, rolling, stacking, and the like. Exemplary sheet materials and papers include, but are not limited to, paper tissue, bath/toilet tissue, paper towels, wipes, label rolls, or other fibrous, film, polymer, or filamentary products. The terms "sheet material" and "paper" may be used interchangeably.

Dispensers for rolled sheet materials, such as for dispensing paper towels, have been developed. Many of these dispensers have mechanisms for dispensing sheet product from a main roll and/or a partially depleted roll, also known as a stub roll. For instance, these dispensers may be configured to dispense from both the stub roll and the main roll at the same time or provide a double sheet dispense until the stub roll is depleted. Other dispensers can include some type of transfer system that permits dispensing from the stub roll until it is fully or nearly fully depleted before the dispenser begins dispensing from the main roll. While transfer systems are useful in reducing product waste, many of them still require appropriate loading of the leading edge of the sheet material from the main roll.

Accordingly, in one embodiment, the present disclosure is directed to a dispenser for dispensing sheet material from one or more rolls of sheet material. The dispenser includes a housing having an interior volume so as to retain a first roll of sheet material. A module housing a dispensing mechanism is disposed within the housing. The dispensing mechanism is configured to dispense sheet material from the first roll of sheet material. The dispensing mechanism includes a drive roller. The dispenser includes a transfer assembly having a rear transfer roller and a front transfer roller disposed on a transfer arm. The transfer arm is disposed in one or more walls of the module via a slot. The transfer arm is configured to be placed in an operating position or a loading position. When in loading position, the transfer arm extends into a second portion of the slot to provide greater clearance between the front transfer roller and the drive roller to facilitate loading of the sheet material.

In another embodiment, the present disclosure is directed to a dispenser for dispensing sheet material from one or more rolls of sheet material. The dispenser includes a housing having an interior volume so as to retain a first roll of sheet material. The dispenser includes a module housing a dispensing mechanism disposed within said housing to dispense sheet material from the first roll. The dispensing mechanism includes a drive roller. The dispenser includes a transfer assembly having a rear transfer roller and a front transfer roller disposed on a transfer arm. A second portion of the transfer arm includes a slot and the rear transfer roller is disposed in the slot. The transfer arm is configured to be placed in an operating position or a loading position. When in the loading position, the rear transfer roller extends into a second portion of the slot to provide greater clearance between the front transfer roller and the drive roller to facilitate loading of the sheet material.

The dispensers according to example embodiments of the present disclosure can provide numerous benefits and technical effects. For instance, configuring the transfer arm to move to a loading position that provides greater clearance between the front transfer roller and the drive roller, makes loading sheet materials into the dispensing mechanism easier. Additionally, the placement of the slot with respect to the transfer arm and/or the rear transfer roller, does not require additional components or complicated mechanics in order to increase clearance between the front transfer roller and the drive roller to facilitating loading of the sheet material.

FIG. 1 illustrates an example embodiment of a dispenser 10 for dispensing a dispensable product in accordance with embodiments of the present disclosure. The dispenser 10, as shown, is configured for dispensing rolled sheet material products, such as rolled sheets of paper towels or toilet paper. The dispenser 10 is particularly suited for dispensing paper towels, tissues, and the like. Generally, the dispenser 10 is configured for dispensing multiple rolls of material. The dispenser is not limited to any particular type of roll material, or any particular application. The dispenser is illustrated in the figures as a paper towel roll dispenser for purposes of illustration only.

As shown in FIG. 1, the dispenser 10 includes a housing 16 having a interior volume 17 that is designed to house one or more rolls of sheet material. For example, the housing 16 can be configured to house a first roll of sheet material 18 (e.g., a main roll) and/or a second roll of sheet material (e.g., a stub roll). The housing 16 may be formed of any suitable material or materials. The housing may take on any manner of shapes or configurations. Generally, the dispenser 10 can include a front cover assembly 20 and a backplate 30. The front cover assembly 20 is shown in an open position. In certain embodiments, the front cover assembly 20 can define one or more of the sidewalls of the dispenser 10. In other embodiments, however, the front cover assembly 20 can form at least a portion, but not substantially all, of the sidewalls of the dispenser. In other embodiments, however, the front cover assembly 20 does not form any portion of the sidewalls of the dispenser. The front cover assembly 20 can be pivotally coupled to the backplate 30. For example, one or more hinges can be used to pivotally couple the front cover assembly 20 to the backplate 30. Any conventional pivotal attaching mechanism may be used in this regard. For example, in certain embodiments, a simple rotatable rod is provided and retained by rod holders. It should be appreciated that any number of conventional pivotal arrangements are known by those skilled in the art and may be utilized to pivotally mount the front cover assembly 20 to the backplate 30. In other embodiments, the front cover assembly 20 can be completely removable or detachable from the backplate 30.

A module 40 is provided in the interior volume 17, the module 40 houses a dispensing mechanism 50. Generally, the dispensing mechanism 50 includes components that are suitable for dispensing sheet material from a roll. For example, the dispensing mechanism 50 can be configured to dispense sheet material from either a first roll and/or a second roll in a controlled manner. For example, the dispensing mechanism 50 can include any type of feed roller and/or nip roller arrangement for advancing sheet material from the roll of sheet material 18 through a dispensing opening. Generally, such feed roller arrangements, including control circuitry for operating said rollers, are known by those of skill in the art. Any known dispensing components can be used to dispense sheet material from the roll of sheet material 18.

The dispenser 10 also include a roll retaining device 22 configured to hold the roll of sheet material 18. While one roll retaining device 22 is shown, the disclosure is not so limited. Indeed, any number of roll retaining devices 22 can be used or incorporated into the dispenser 10 disclosed herein. For example, in embodiments where the dispenser 10 is configured to hold at least two rolls of sheet material 18, at least two roll retaining devices 22, such as a first roll retaining device and a second roll retaining device, can be used. In certain embodiments, a first roll retaining device can be used to hold a first roll of sheet material (e.g., a main roll) and a second roll retaining device can be used to hold a second roll of sheet material (e.g., a stub roll). Roll retaining devices 22 are generally known in the art and are capable of supporting a roll of sheet material such that sheet material can be unrolled and dispensed via a dispensing opening in the dispenser. For example, certain roll retaining devices have an arm with a nub and/or hub thereon, the nub or hub can be inserted into the core diameter of the roll, thus allowing the roll to move circumferentially in order to dispense sheet material from the roll. Any known configurations of roll retaining devices can be used herein.

Figure 2:
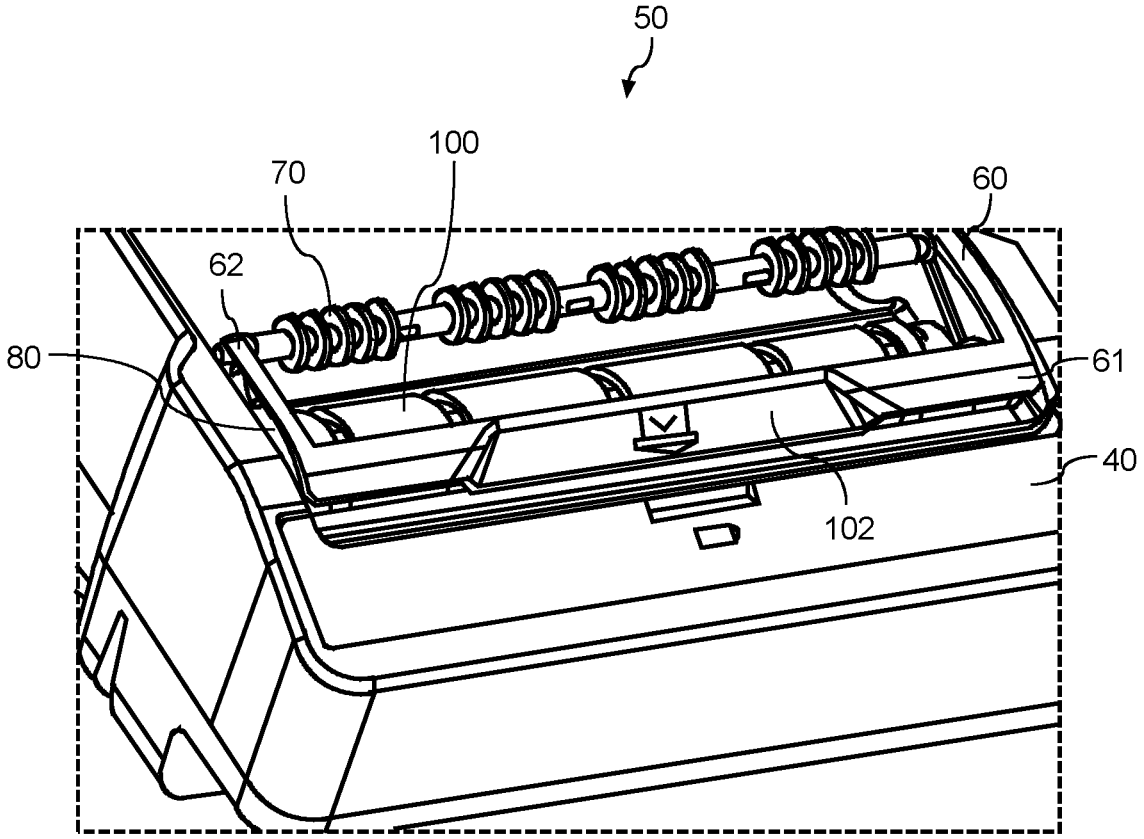
FIG. 2 illustrates a partial perspective view of a housing and transfer mechanism according to example embodiments of the present disclosure.
Figure 3:
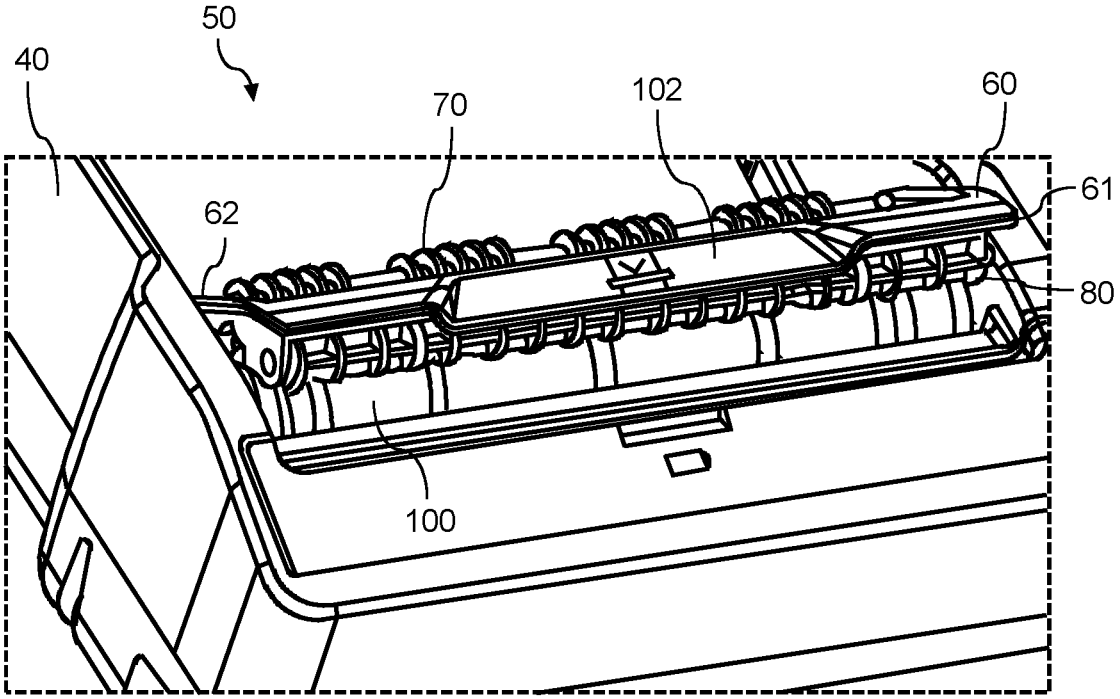
FIG. 3 illustrates a partial perspective view of a housing and transfer mechanism according to example embodiments of the present disclosure.

As shown in FIGS. 2-3, the dispensing mechanism 50 can include a transfer arm 60. The transfer arm 60 includes a front portion 61 and a rear portion 62. Generally, a rear transfer roller 70 is disposed along the rear portion 62 of the transfer arm 60. A front transfer roller 80 is disposed along a front portion 61 of the transfer arm 60. The transfer arm 60 is disposed within the module 40 housing the dispensing mechanism 50. The transfer arm 60 is shown in a dispensing position in FIG. 2 and is shown in a loading position in FIG. 3. As shown, when in dispensing position, the front transfer roller 80 is biased against the drive roller 100. The sheet material from the roll of sheet material 18 is disposed between the front transfer roller 80 and the drive roller 100, and is advanced along a dispensing path and through a dispensing opening by the driver roller 100. When in loading position, the front transfer roller 80 has been lifted such that it is no longer in contact with the drive roller 100. However, when in loading position, the transfer arm 60 can be lifted, or pivoted around a pivot point, until the rear transfer roller 70 makes contact with the drive roller 100. As shown, the transfer arm 60 includes a tab 102. The tab 102 is positioned such that a user can easily access the tab 102 to lift the transfer arm 60 in order to move the transfer arm 60 between the loading position and the dispensing position. The transfer arm 60 can be attached and/or connected to the housing 40 via any suitable mechanism. For example, in certain embodiments, the transfer arm is pivotally connected to one or more walls of the housing 40. Any suitable pivot connection can be used that allows the transfer arm 60 to move between the loading position and the dispensing position.

Figure 4:
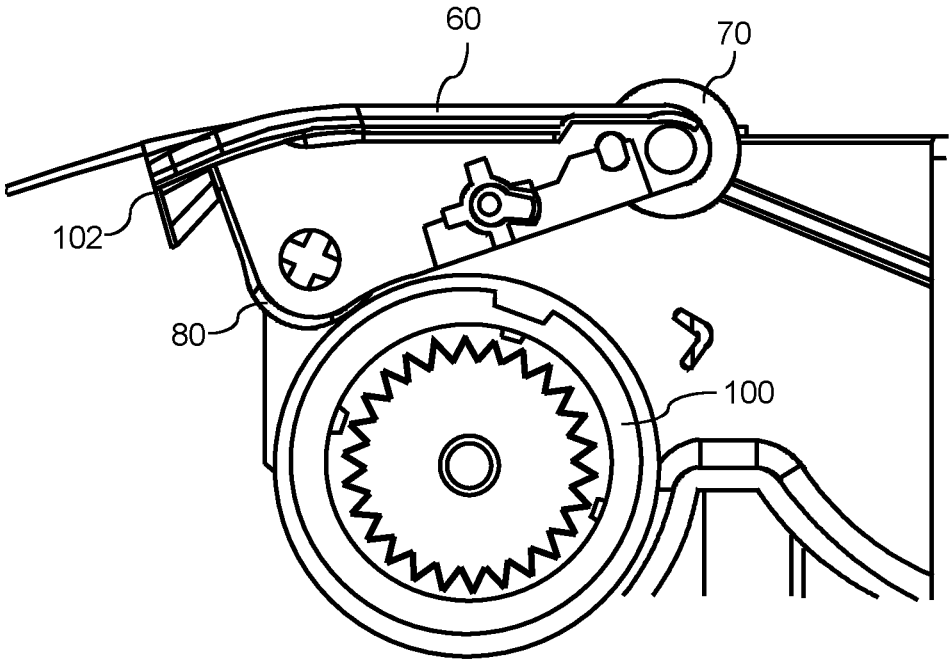
FIG. 4 illustrates a cross-sectional view of a transfer mechanism and driver roller assembly in dispensing position according to example embodiments of the present disclosure.
Figure 5:
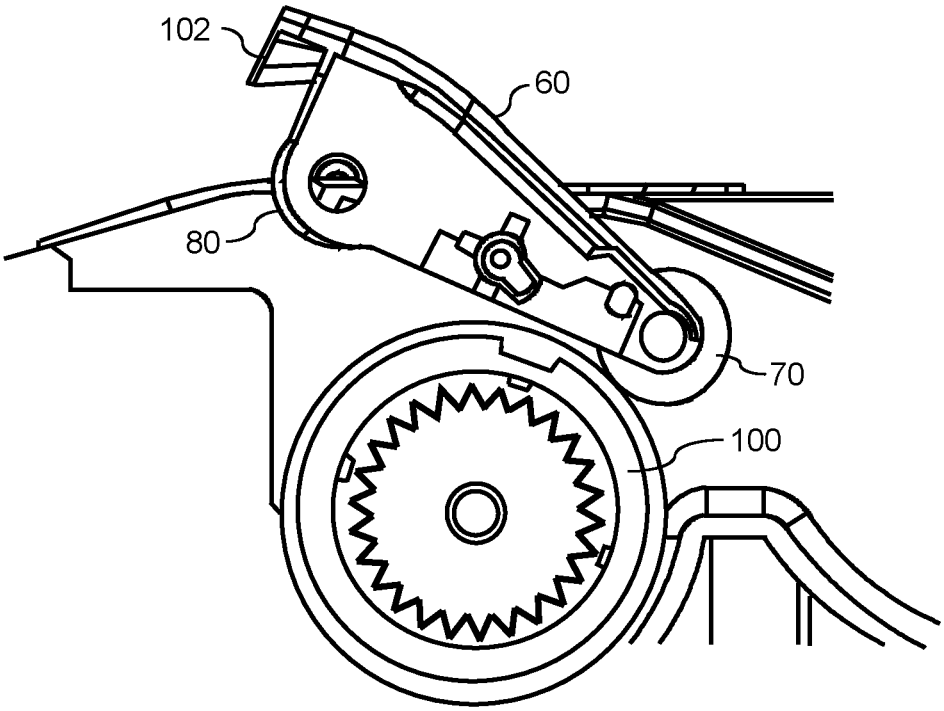
FIG. 5 illustrates a cross-sectional view of a transfer mechanism and driver roller assembly in loading position according to example embodiments of the present disclosure.

Referring now to FIGS. 4 and 5, a cross section view of the transfer arm 60 in dispensing position (FIG. 4) and loading position (FIG. 5) is shown. As shown in FIG. 4 the transfer arm 60 is in dispensing position having the front transfer roller 80 biased against the drive roller 100. Sheet material can be dispensed by driving material between the front transfer roller 80 and the drive roller 100. As shown in FIG. 5, the transfer arm is in loading position with the front transfer roller 80 in a lifted position (e.g., not biased against the drive roller 100) with the rear transfer roller 70 biased against the drive roller 100.

Figure 6:
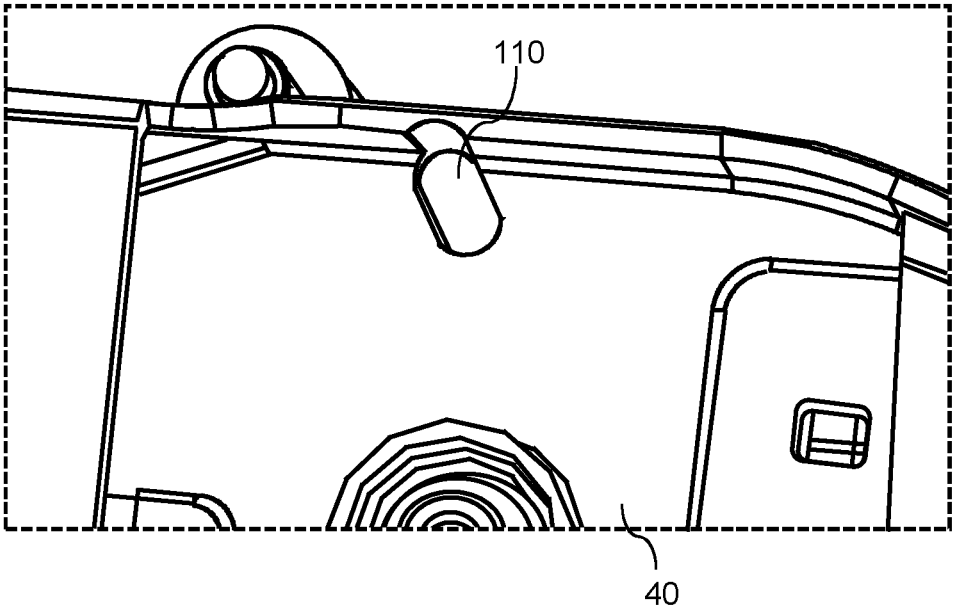
FIG. 6 illustrates a cross-sectional view of housing having a slot according to example embodiments of the present disclosure.
Figure 7:
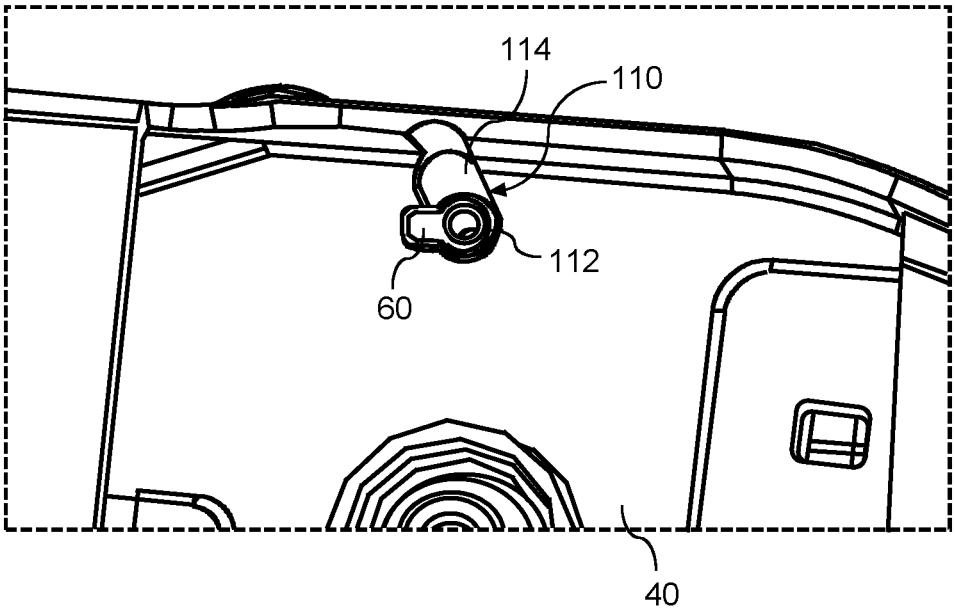
FIG. 7 illustrates a cross-sectional view of a housing having a slot with a transfer arm in dispensing position according to example embodiments of the present disclosure.
Figure 8:
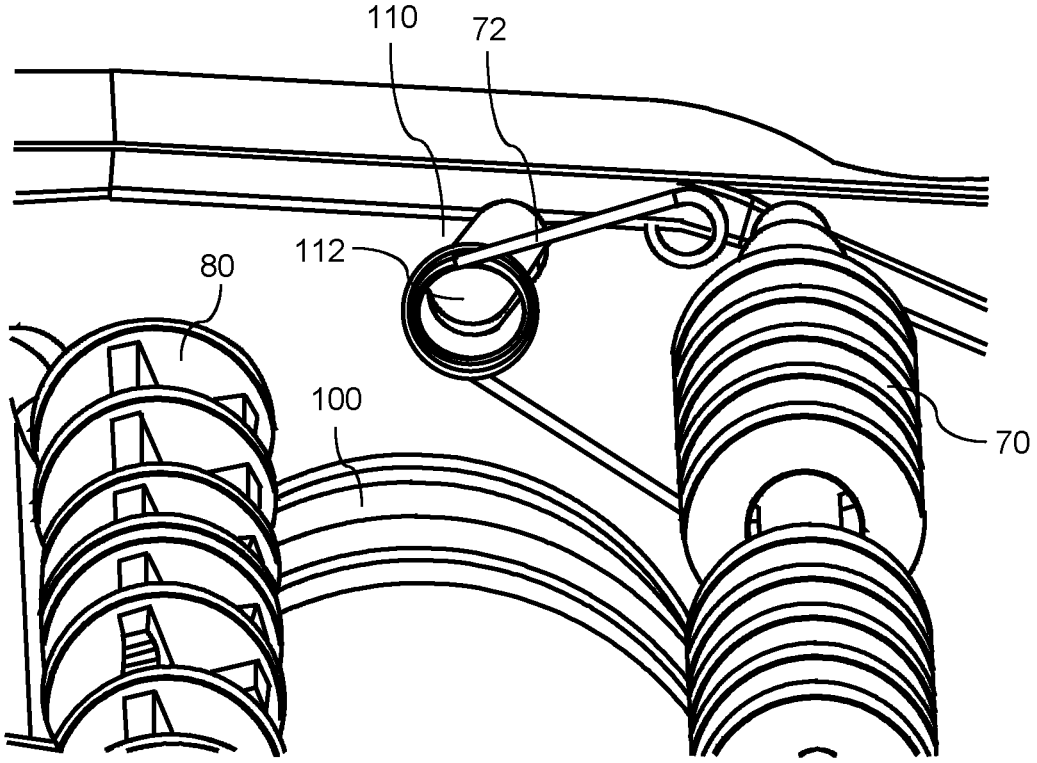
FIG. 8 illustrates a transfer arm in dispensing position according to example embodiments of the present disclosure.

As shown, lifting of the transfer arm 60 to move it to loading position, causes the rear transfer roller 70 to contact the drive roller 100, which can effectively limit the range of motion for the transfer arm 60. However, as provided herein, the transfer arm 60 is disposed in a slot 110 located in one or more walls of the housing 40 holding the dispensing mechanism 50. FIG. 6 illustrates the slot 110 in one or more walls of the housing 40 without having the transfer arm 60 disposed therein. However, as shown in FIG. 7, at least a portion of the transfer arm 60 is disposed in the slot 110. The slot 110 has a first portion 112 and a second portion 114. For instance, in FIG. 7, a portion of the transfer arm 60 is disposed in a first portion 112 of the slot 110, when the transfer arm 60 is in dispensing position. Stated differently, when the transfer arm 60 is in dispensing position, the transfer arm 60 is disposed in a first portion 112 of the slot 110. As shown in FIG. 8, the transfer arm 60 can be held in place with a torsion spring 72. Accordingly, when it is time to load sheet material, the user can easily overcome the force of the torsion spring 72 to move the transfer arm 60 to loading position.

Figure 9:
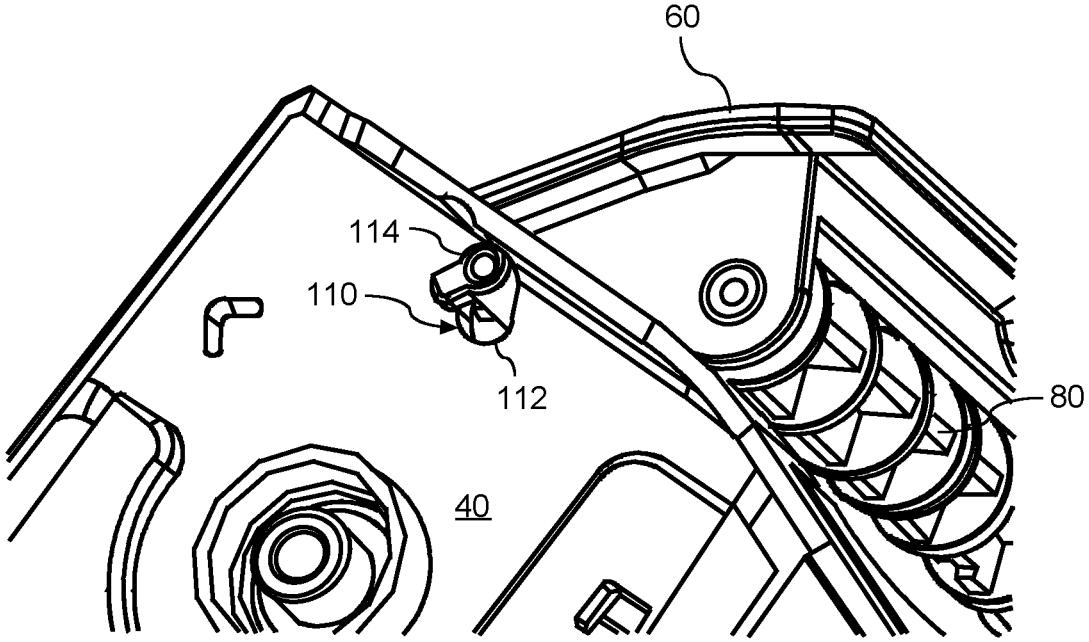
FIG. 9 illustrates a partial perspective view of a slot with a transfer arm in loading position according to example embodiments of the present disclosure.

FIG. 9 illustrates the transfer arm 60 in a loading position having a portion of the transfer arm 60 disposed in a second portion 114 of the slot 110. As previously described, when the transfer arm 60 is being moved from a dispensing position to a loading position, the rear transfer roller 70 comes into contact with the drive roller 100, effectively limiting the range of motion of the transfer arm 60. Such limitation also limiting the amount of distance or clearance between the front transfer roller 80 and the drive roller 100. In order to increase the clearance and/or distance between the drive roller 100 and the front transfer roller 80 during loading, when the rear transfer roller 70 contacts the drive roller 100, the transfer arm 60 is able to pivot within the slot 110 from the first portion 112 of the slot 110 to the second portion 114 of the slot 110, thereby allowing for greater clearance between the front transfer roller 80 and the drive roller 100.

Figure 10:
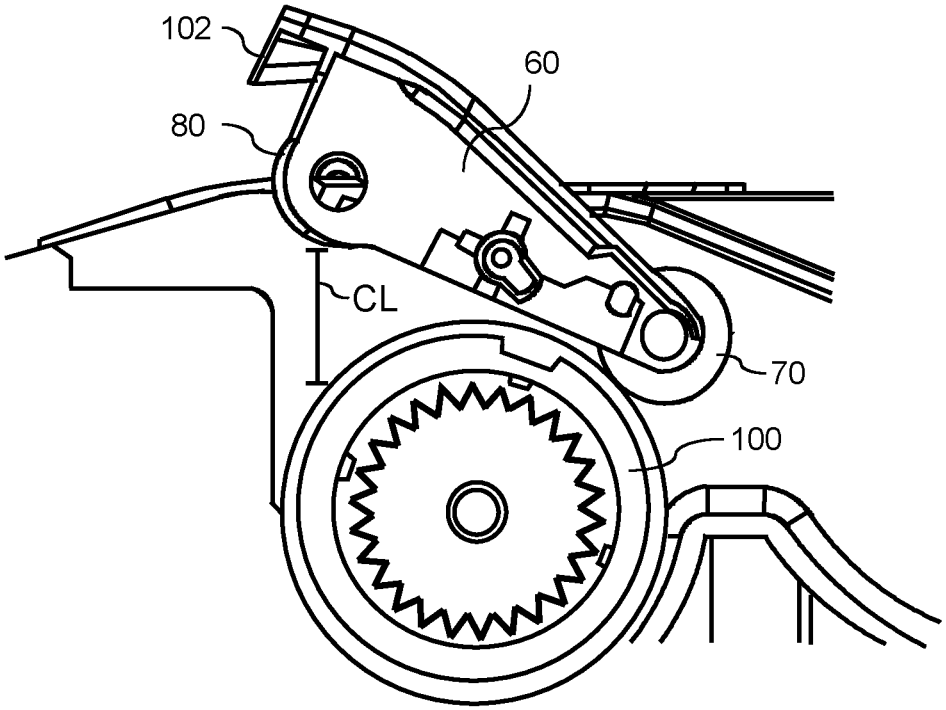
FIG. 10 illustrates a cross-sectional view of a transfer arm in loading position with the transfer arm in a first portion of the slot according to example embodiments of the present disclosure.
Figure 11:
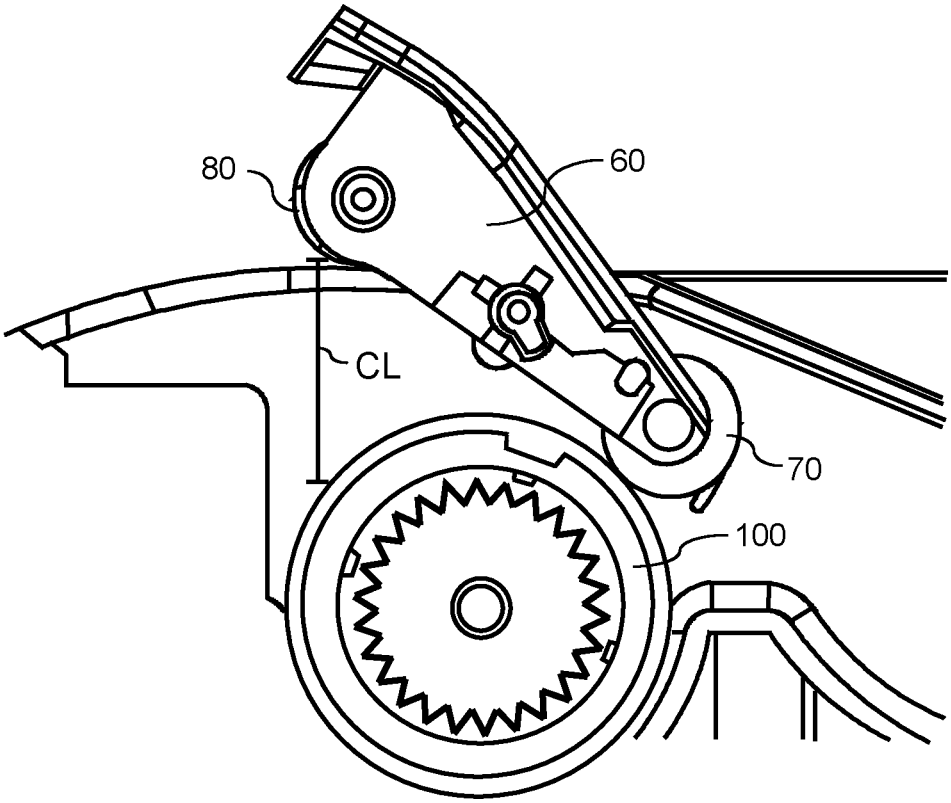
FIG. 11 illustrates a cross-sectional view of a transfer arm in loading position with the transfer arm in a second portion of the slot according to example embodiments of the present disclosure.

For example, FIG. 10 illustrates the transfer arm 60 in loading position where the transfer arm 60 is located in a first portion 112 of the slot 110, while FIG. 11 illustrates the transfer arm 60 in loading position with the transfer arm 60 in a second portion 114 of the slot 110. As can be seen, the clearance (CL) between the front transfer roller 80 and the drive roller 100 is greater when the transfer arm 60 is located in the second portion 114 of the slot 110 (see FIG. 11) as compared to when the transfer arm 60 is located in the first portion 112 of the slot 110 (see FIG. 10).

Figure 12:
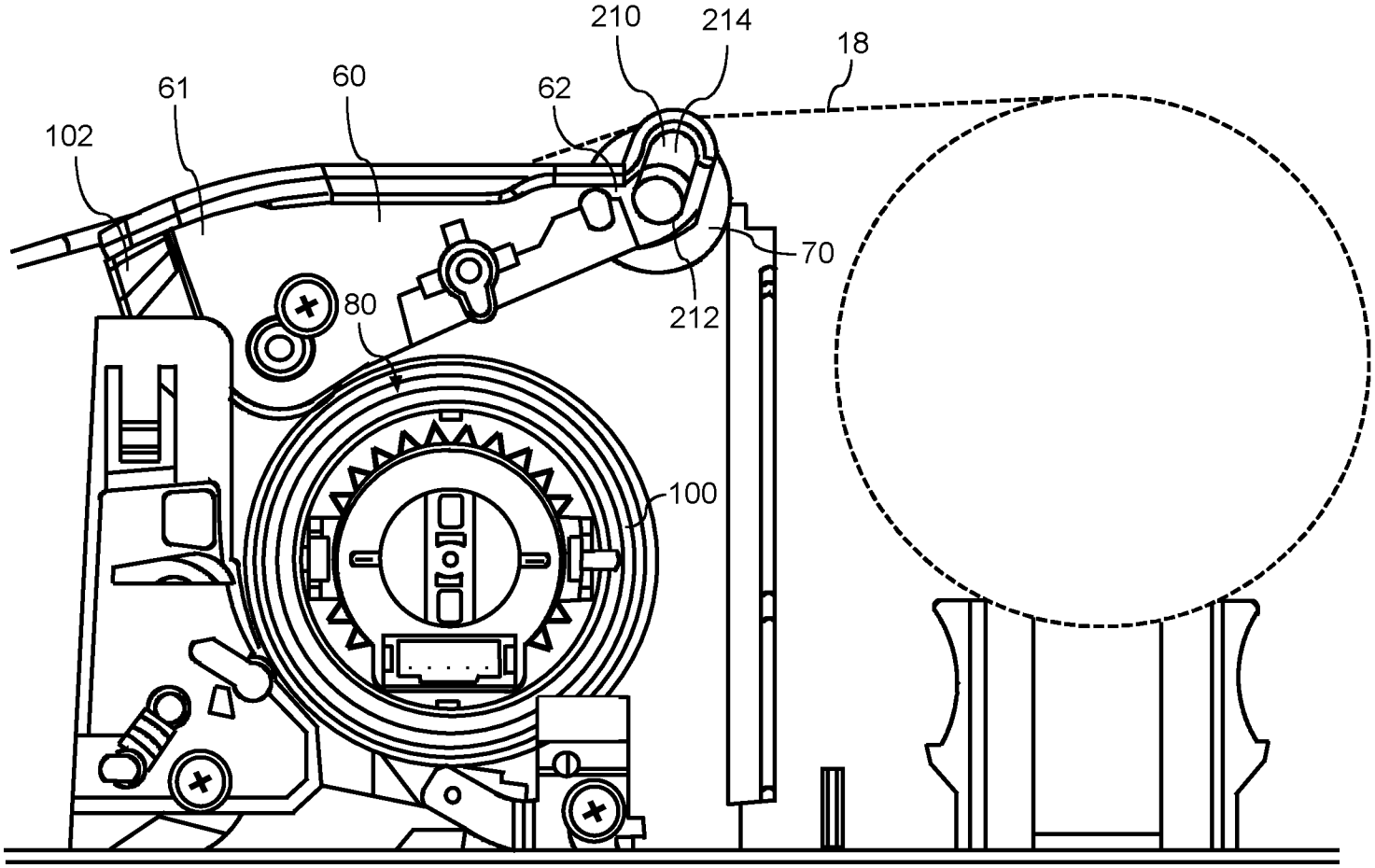
FIG. 12 illustrates a cross-sectional view of a transfer arm in loading position with the rear transfer roller in a first portion of the slot according to example embodiments of the present disclosure.
Figure 13:
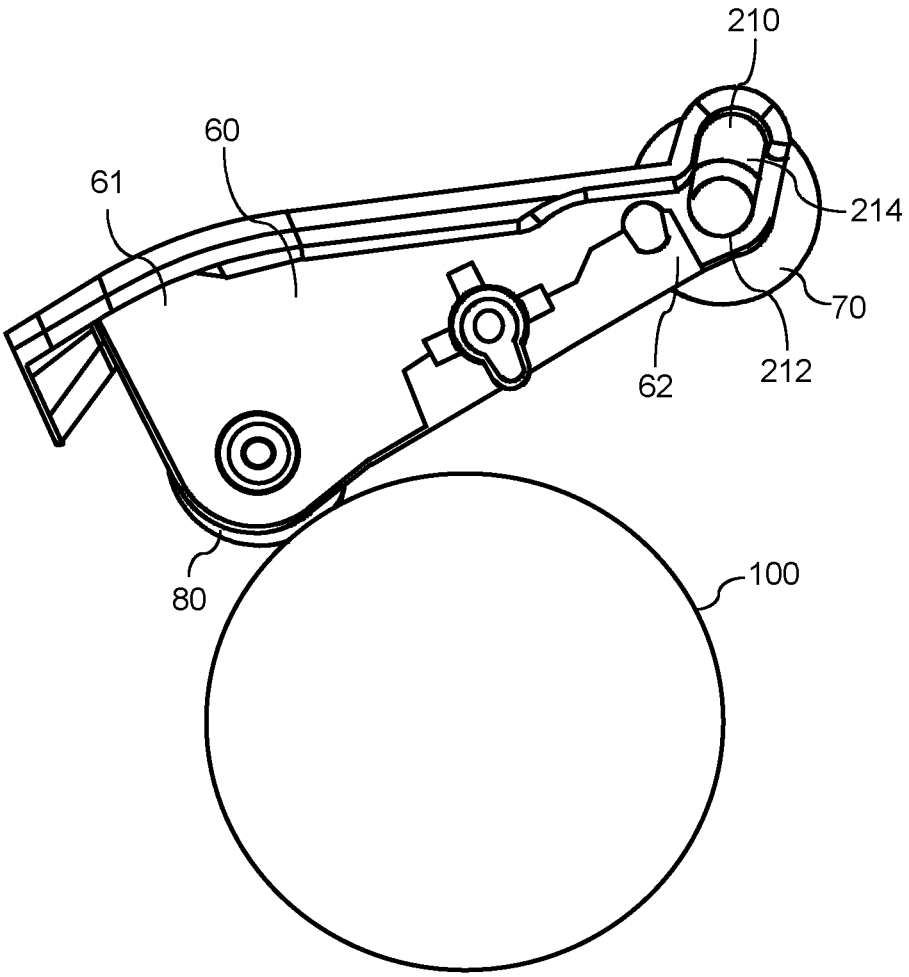
FIG. 13 illustrates a cross-sectional view of a transfer arm in loading position with the rear transfer roller in a first portion of the slot according to example embodiments of the present disclosure.

Now referring to FIGS. 12-13, in certain embodiments, the transfer arm 60 includes a front portion 61 and a rear portion 62, the rear portion 62 is outfitted with a slot 210. Similar to slot 110 disposed in the housing 40, slot 210 include both a first portion 212 and a second portion 214. The rear transfer roller 70 is disposed within the slot 210. For example, each end of the rear transfer roller 70 can be disposed in slot 210. As shown in FIG. 12, the transfer arm 60 is in dispensing position with the front transfer roller 80 biased against the drive roller 100. Sheet material from the roll of sheet material 18 is fed over the rear transfer roller 70 and is disposed between the front transfer roller 80 and the drive roller 100 for dispensing.

Figure 14:
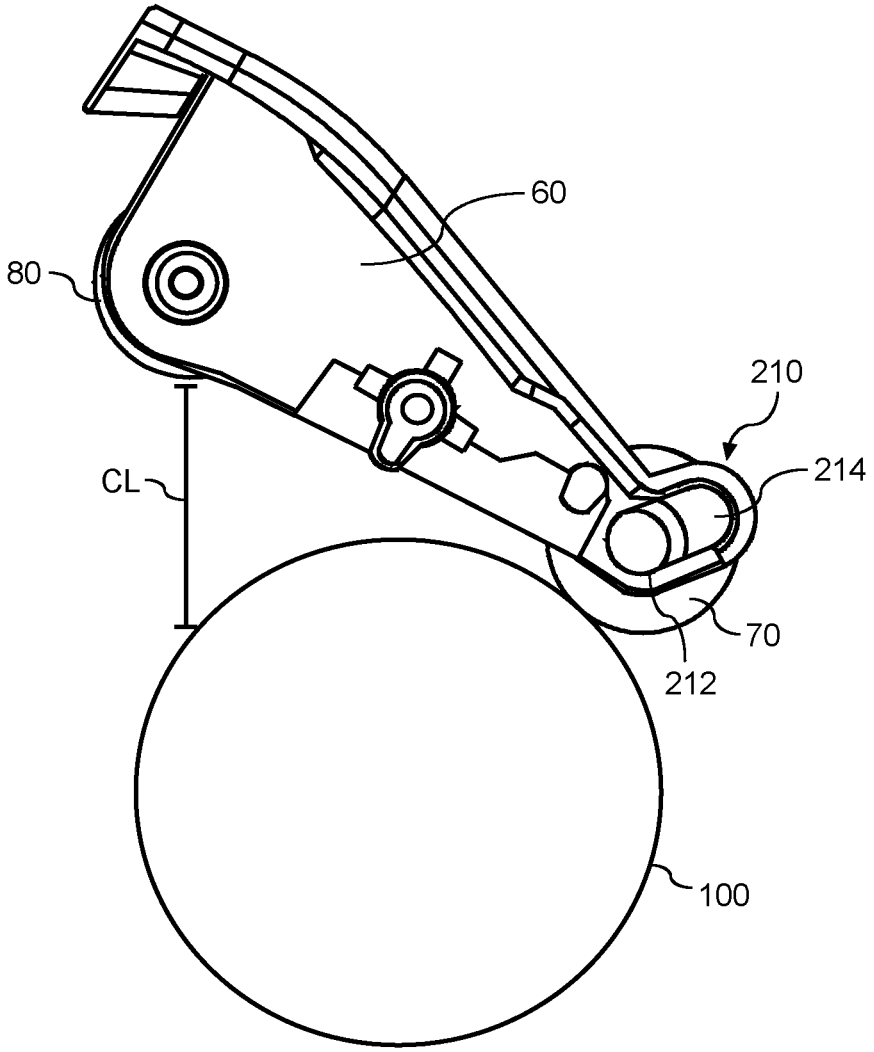
FIG. 14 illustrates a cross-sectional view of a transfer arm in loading position with the rear transfer roller in a first portion of the slot according to example embodiments of the present disclosure.
Figure 15:
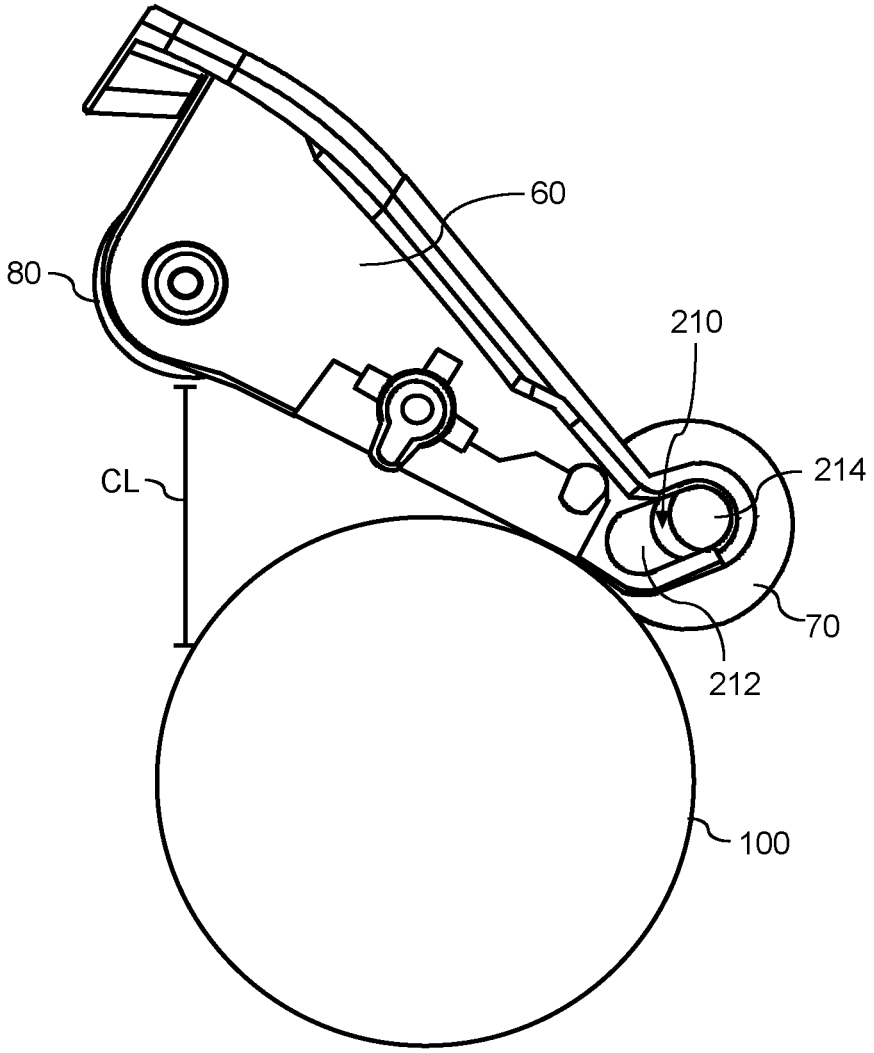
FIG. 15 illustrates a cross-sectional view of a transfer arm in loading position with the rear transfer roller in a second portion of the slot according to example embodiments of the present disclosure.

FIG. 14 illustrates the transfer arm 60 in loading position, that is with the front transfer roller 80 lifted from the drive roller 100 and the rear transfer roller 70 in contact with the drive roller 100. As shown, the rear transfer roller 70 is disposed in first portion 212 of slot 210. When the rear transfer roller 70 is disposed within the first portion 212 of the slot 210, there is a certain amount of clearance (CL) between the front transfer roller 80 and the drive roller 100. However, as shown in FIG. 15, the rear transfer roller 70 can be further biased against the drive roller 100, in order to move the rear transfer roller 70 to the second portion 214 of the slot 210. When rear transfer roller 70 is positioned within the second portion 214 of the slot 210, the clearance (CL) between the front transfer roller 80 and the driver roller 100 is increased, thus allowing for easier loading of sheet material.

Accordingly, embodiments of the present disclosure include features (e.g., slots) that are positioned to allow the transfer arm 60 and/or the rear transfer roller 70 to occupy different positions within the slots in order to increase clearance between the front transfer roller 80 and the drive roller 100 to facilitate loading of sheet material.

The dispensers provided herein can also be outfitted with any number of operational components. The operation components can be housed in the housing and/or located external to the housing. Suitable operational components can vary depending on the type of dispenser and product to be dispensed. For example, the operational components of the dispenser can be mounted directly to the backplate of the housing or can be part of a module that is received within the housing. For example, the operational components can be part of a module that may be readily removable from the housing for servicing and/or replacing components without the necessity of having to remove the entire dispenser from its support surface. For dispensing paper products, such as one or more rolls of sheet material, the operational components can include rollers, such as pressure rollers, drive rollers, drive motors, gear assemblies, and control circuitry, including, for example, controllers or microprocessors, for driving paper product from the roll of sheet material out through a dispensing opening. Additional roll holders, including main roll holders and stub roll holders, can also be included in the dispenser. Additional transfer mechanisms may also be present in order to transfer dispensing between a stub roll and a main roll. Such components are known by those of skill in the art and can be incorporated accordingly herein. Additionally, tear bars or cutting bars may be present in order to cut the paper product as it is dispensed from the dispensing material. In certain embodiments, the dispenser can be configured to dispense a particular amount of sheet material. Dispensing mechanisms can be powered by batteries in a battery component or can be powered by an AC to DC distribution system.

Additionally, any variety of known sensors can be included in the dispenser provided herein. For example, in certain embodiments, the dispenser can include a sensor capable of detecting the presence of a user in a detection zone and administering a select amount of dispensable product accordingly. Such detection sensors are known in the art. Furthermore, additional refill detection sensors and/or systems are known and can be incorporated into the dispensers provided herein.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for dispensing sheet material from one or more rolls of sheet material, comprising:

a housing having an interior volume so as to retain a first roll of sheet material;

a module including a dispensing mechanism disposed within the housing to dispense sheet material, the dispensing mechanism including a drive roller; and a transfer assembly having a rear transfer roller and a front transfer roller disposed on a transfer arm, the transfer arm disposed in one or more walls of the module via a slot, the transfer arm configured to be placed in an operating position or a loading position;

wherein, when in the loading position, the transfer arm extends into a second portion of the slot to provide greater clearance between the front transfer roller and the drive roller to facilitate loading of the sheet material and the rear transfer roller is biased against the drive roller.

2. The dispenser of claim 1, comprising a first roll retaining device for holding the first roll of sheet material.

3. The dispenser of claim 1, wherein the housing is configured to retain a second roll of sheet material.

4. The dispenser of claim 3, comprising a second roll retaining device for holding the second roll of sheet material.

5. The dispenser of claim 1, wherein the transfer arm comprises a tab disposed such that a user can access the tab to lift the transfer arm to move the front transfer roller from the operating position to the loading position.

6. The dispenser of claim 1, wherein, when in the loading position, the sheet material can be placed over the rear transfer roller and between the drive roller and the front transfer roller.

7. The dispenser of claim 1, wherein, when in operating position, the sheet material is advanced along a dispensing path between the drive roller and the front transfer roller.

8. The dispenser of claim 1, wherein, when in operating position, the transfer arm is disposed in a first portion of the slot.

9. The dispenser of claim 1, comprising a dispensing opening through which sheet material is dispensed from the interior volume.

10. A dispenser for dispensing sheet material from one or more rolls of sheet material, comprising:

a housing having an interior volume so as to retain a first roll of sheet material;

a module including a dispensing mechanism disposed within said housing to dispense sheet material, the dispensing mechanism including a drive roller; and a transfer assembly having a rear transfer roller and a front transfer roller disposed on a transfer arm, the transfer arm having a first portion and second portion, the second portion comprising a slot having the rear transfer roller disposed therein, the transfer arm configured to be placed in an operating position or a loading position;

wherein, when in the loading position, the rear transfer roller extends into a second portion of the slot to provide greater clearance between the front transfer roller and the drive roller to facilitate loading of the sheet material and the rear transfer roller is biased against the drive roller.

11. The dispenser of claim 10, wherein the transfer arm comprises a tab disposed such that a user can access the tab to lift the transfer arm to move the transfer arm from the operating position to the loading position.

12. The dispenser of claim 10, wherein, when in the loading position, the sheet material can be placed over the rear transfer roller and between the drive roller and the front transfer roller.

13. The dispenser of claim 10, wherein, when in operating position, the sheet material is advanced along a dispensing path between the drive roller and the front transfer roller.

14. The dispenser of claim 10, wherein, when in operating position, the rear transfer roller is disposed in a first portion of the slot.

15. The dispenser of claim 10, comprising a dispensing opening through which sheet material is dispensed from the interior volume.

16. The dispenser of claim 10, comprising a first roll retaining device for holding the first roll of sheet material.

17. The dispenser of claim 10, wherein the housing is configured to retain a second roll of sheet material.

18. The dispenser of claim 17, comprising a second roll retaining device for holding the second roll of sheet material.

* * * * *